US005765981A

United States Patent [19]

Huang et al.

[11] Patent Number: 5,765,981

[45] Date of Patent: Jun. 16, 1998

[54] WIRE ROPE TENSIONING AND REEVING SYSTEM FOR CARGO CONTAINER HANDLING CRANES

[75] Inventors: Sun H. Huang, Fremont; Hans G. Vosskamp, Foster City, both of Calif.

[73] Assignee: Paceco Corp., San Mateo, Calif.

[21] Appl. No.: 862,794

[22] Filed: May 23, 1997

[51] Int. Cl.[6] ..... B66C 5/02

[52] U.S. Cl. ..... 414/140.3; 414/141.3; 212/316

[58] Field of Search ..... 414/140.3, 141.3, 414/141.4; 212/316, 322, 324, 325, 257, 195, 503

[56] References Cited

U.S. PATENT DOCUMENTS

| | | | |
|---|---|---|---|
| 685,056 | 10/1901 | Norris | 212/232 |
| 2,650,718 | 9/1953 | Palmer | 212/195 |
| 3,207,329 | 9/1965 | Bevard | 212/322 |
| 3,722,705 | 3/1973 | Gould | 414/141.4 |
| 5,409,123 | 4/1995 | Steiner | 414/141.3 |
| 5,570,986 | 11/1996 | Hasegawa et al. | 414/140.3 |

*Primary Examiner*—Karen M. Young
*Assistant Examiner*—Gregory A. Morse
*Attorney, Agent, or Firm*—Bruce & McCoy

[57] ABSTRACT

An Improved Catenary Wire Rope Tensioning and Reeving System for Cargo Container Handling Cranes wherein the wire rope reeving for the catenary wire rope support trolleys is passive by being dead-ended to weights whereby it is continuously active.

4 Claims, 5 Drawing Sheets

WIRE ROPE TENSIONING AND REEVING SYSTEM FOR CARGO CONTAINER HANDLING CRANES

BACKGROUND OF THE INVENTION

1. Field of the Invention

The present invention relates to cargo container handling gantry cranes and, particularly, it relates to an improvement in the tensioning and reeving of a catenary wire rope support system for the main cargo container handling trolley of such cranes. More specifically, it relates to an improvement for the wire rope suspension system for cantilever boom gantry cranes which are retractable by rotating the boom portion of the gantry about their inboard ends which are hinged to the crane superstructure.

2. Description of the Prior Art

The present invention relates to cargo container handling gantry cranes which when arranged in the operating configuration extend over a longitudinal expanse to transfer cargo containers horizontally from one deposition area to another. The largest of such gantry cranes are usually located in railroad yards and dockside in shipping ports around the world. Generally, the dockside cranes either have a horizontal sliding boom or a cantilever boom which can be raised by rotating it around its inboard end. Long span yard cranes are typically supported by vertical structures located inboard from the ends of the cranes on rail-mounted wheels. The present invention can be utilized on any of these basic types of crane designs, but is especially adapted for the raisable boom design.

An example of this type of crane is disclosed in U.S. Pat. No. 5,570,986 developed by the assignee of the present invention.

Reference is made to FIG. 1 of the drawings for a representation of one such type of crane having a cantilevered rotatable boom 11 for which the present invention is specifically designed and especially adapted. The crane superstructure 13 is supported on crane truck wheels 15 which are mounted on dock rails which run parallel to the edge of the harbor dock. The superstructure supports a horizontal gantry 17 disposed generally mid-height thereon at an elevated location above the cargo container pickup and deposition areas 19. The gantry is supported from below by the main legs of the superstructure. In the cantilevered rotatable boom design, sheaves are disposed at the pinnacle 21 of the superstructure of the crane to guide wire rope reeving 23 which is used to rotate the outboard or cantilevered end of the boom to the upright raised stowed position. The outboard end of the boom is also supported from the pinnacle by mechanical links 25. The load supporting links for the retractable gantry are collapsible. The wire rope reeving which raises the boom takes the load off the links which collapse when the cantilevered boom is rotated to its stowed position about its hinge point 27 at its inboard end proximate the superstructure.

While, in most typical dockside applications, the gantry of a cargo container handling crane is a slidable or raisable cantilever boom extending from a crane superstructure, large gantry yard cranes supported at both ends are located in large cargo container storage or transfer areas. All of these cranes employ a movable trolley 29 with a suspended operator's cab 31 which shuttle along the gantry 17 and boom 11 suspending a cargo container lifting spreader 33. The spreader can be raised or lowered from the crane gantry by the operator and engages the cargo containers 35 which are on the dock or shipboard to permit them to be lifted by the trolley for transport along the gantry to the deposition area 19. The trolley is reciprocated along the gantry by a continuous wire rope system which is driven by wire rope drums located in the machinery house 37.

When a cargo container transport ship 39 is berthed alongside a dock, the gantry crane is moved along the dock parallel to the ship to a position where a retractable boom 11 can be lowered or extended across the beam of the ship above the ship's cells which are disposed in the cargo container carrying area. Containers can be transported along the gantry of the crane between the dockside pickup and deposition area and any storage position located within the beam of a berthed ship in its holds or on its deck.

When the ships either dock or cast off, they generally must move along the dock until they tie up or reach navigable water. To do so, the container boom 11 of the gantry crane must be retracted so it does not interfere with the ship superstructure. The retractable boom, in its retracted position, clears the superstructure of any ship berthed or moving alongside the dock adjacent to the crane. Some gantries are designed to reciprocate horizontally to achieve this purpose, particularly in areas where there are height restrictions, such as often occurs if the crane is located proximate an airport approach or departure corridor. The more economical cranes, however, utilize the rotatable or raisable cantilever boom arrangement.

The gantry portion 17 of the cargo container handling cranes includes the retractable boom 11 and a dockside gantry portion and a rear extension 41 of said gantry supported by the crane superstructure. The purpose of a gantry crane is to move cargo containers a specific horizontal distance from a pickup area to a deposition area 19. The pickup area is either a dockside location where a container is picked off of a flatbed trailer or transport truck or railroad car, and moved outboard by the crane and lowered into a shipboard cargo container cell, or the reverse. The three portions of the crane gantry provided for this purpose extend over a relatively long span.

The cargo container lift trolley 29 mounted on rails on the crane gantry 11, 17, 41 can traverse from one end of the gantry to the other. The trolley suspends the cargo container lifting spreader 33 from fleet-through wire rope reeving. The fleet through wire lift ropes and the trolley drive ropes sag in catenary curves from their contact with the trolley to the ends of the gantry where they run through reversing sheaves. The sag is naturally the greatest when the trolley is at one of the ends of the gantry. The rope sag is energy consuming and detrimental to crane operation.

The status of prior art relating to the area of the present invention is disclosed in the accompanying drawings which illustrate the apparatus and method by which tension and force is imposed upon the wire rope reeving for the main cargo transport trolley of a shoreside cargo container handling crane. Reference is made to FIG. 2 for an illustration of the basic wire rope reeving for the main trolley drive of these gantry cranes. In the normal configuration of wire rope reeving, the trolley drive wire ropes 43, are driven by one or a pair of trolley drive drums 45. Portions of the rope are either towing or slack depending on the direction of movement of the trolley, and the rope is always active and continuously in motion when the trolley moves. Other wire ropes may either have free ends or static ends which are secured to a movable or static anchor. They may be passively driven, drum driven, deadweight driven or static.

The drive drums 45 for the main trolley drive ropes 43 are usually located somewhere mid-span on the gantry 17 in a machinery house 37. The pairs of drive ropes extend from the drums to reversing sheaves 47 disposed at opposite ends of the gantry. The ropes extend from the reversing sheaves to the cargo container transport trolley movably located anywhere along the gantry. Operation of the drive drums moves the trolley in one direction along the gantry while reverse rotation of the drive drums reverses the tension and slack forces in the drive ropes and the movement of the trolley.

In addition to the drive ropes, the lift ropes for the lifting spreader 33 are integrated into the wire rope reeving system. They are very similar in orientation, operation, and location to the drive ropes in the sense that they are also continuous, driven by drive drums, and run through reversing sheaves at opposite ends of the crane gantry. They differ, however, in that they are not reeved to the main trolley but are reeved through fleet-through sheaves mounted on the trolley whereby they travel downward to the lifting spreader and back up to the trolley. They operate independent of the drive ropes and can be static or moving as the trolley moves along the gantry depending on whether the lifting spreader is being lifted or lowered while the trolley moves.

If the lift and drive wire ropes 43 are unsupported, they sag in a catenary curve between their connection to the trolley 29 and their wrap around the gantry end reversing sheaves 47. The sag of the lift and drive ropes is minimized by the use of tensioner sheaves 49. In a typical installation, the tensioner sheaves are mounted in independent vertically movable slides. Force is applied to the slides supporting the sheaves to keep tension on the continuous wire drive ropes. In the illustration of FIG. 2 which is representative of a typical installation, the effective force on the tension sheaves obviously would be upward.

In an effort to eliminate more of the sag in the drive ropes, catenary support trolley systems have been utilized along with the rope tensioning system. Illustrated in FIG. 3 is a representation of a prior art catenary wire rope suspension system designed for this purpose. The main cargo container transport trolley 29 is bracketed between two catenary wire rope support trolleys 51, 53 which, by virtue of the inherent design of the reeving of the drive ropes, travel at one-half the speed of the main lift trolley and remain mid-span of the distance between the container transport trolley and their respective ends of the gantry. The catenary trolley wheels 55 ride on the same rails on the crane gantry as do the wheels 57 of the cargo transport trolley. The wire rope reeving illustrated by FIG. 3 is supplemental to the wire rope reeving illustrated by FIG. 2 for driving the main lift trolley, and the lift ropes which are not shown, and is integrated therewith.

The two catenary trolleys 51, 53 are driven by two passive wire rope sub-drives 59, 61 which are secured to the main lift trolley 29 whereby as the main trolley moves, the two catenary trolleys move in synchronization with it. The sub-drives employ both static and continuous loop wire ropes, both of which are passive. Therefore, no separate power input or wire rope drive is needed for the two catenary trolleys.

The first pair of sub-drive wire ropes 59 are static and adjustably dead-ended to the cargo transport or main trolley 29 with adjustable turnbuckle connections 63 which engage fixed studs 65 which are secured to and project from the trolley. The two first sub-drive wire ropes 59 extend in opposite directions from the main trolley and are reeved through moving reversing sheaves 67 mounted on the respective catenary support trolleys 51, 53 and are dead-ended on the crane superstructure proximate the middle thereof also with adjustable turnbuckle connections 69. One end of the pair of first sub-drive ropes is reeved around a pair of equalizer reversing sheaves 71 before they are dead-ended.

Not illustrated on the catenary trolleys are the fleet through sheaves which support the lift and drive ropes for the main trolley nor are the fleet through sheaves shown on the main trolley for the lift ropes. The catenary trolley fleet through sheaves constantly support the separate drive and lift rope systems mid-length between the cargo transport trolley and the opposite ends of the crane gantry due to the synchronous operation of the support trolleys with the main trolley. The arrangement cuts in half the catenary sag span of all the supported wire ropes continuously on each side of the main trolley irrespective of where the trolley is positioned along the gantry at any given time.

The second pair of sub-drive wire ropes 61 are, in effect, continuous loops, as if their ends were connected, although they are open between the catenary support trolleys 51, 53. The ropes are secured to the trolleys with bridles 73 which engage the mounting brackets of the reversing sheaves 67 for the first sub-drive wire ropes 59. This arrangement transfers the loads onto the first sub-drive static wires directly without imposing stresses on the support trolleys. The second sub-drive wire ropes extend outward from the catenary trolleys in opposite directions and are reeved around reversing sheaves 75 disposed at the opposite ends of the gantry. The second set of sub-drive ropes extend inward from the ends of the gantry and are reeved into a sheave system around pairs of sheaves 77 secured to the crane superstructure proximate the middle of the crane gantry. One of the pairs of sheaves is movable and, in effect, spring loaded by machinery to impose tension on the second pair of sub-drive ropes.

The catenary wire rope support system of this design includes typical machinery which provides the rope tensioning and the rope compensation for the drive wires for the pairs of sub-drive ropes for the catenary trolleys. Uniquely, one system provides tension for both pairs of sub-drives. It typically consists of a pair of large bore and long stroke hydraulic cylinders 79 that are integrated into the system as rope tensioners by engaging the movable sheaves in the second passive sub-drive system. The other ends of the cylinders are anchored to the crane superstructure. A hydraulic power unit provides the hydraulic pressure for the tensioning cylinders while a service platform, cylinder mounting supports, hydraulic piping, and electric wiring are also required to provide an operative system. These elements are all eliminated by the present invention.

A particular problem occurs for these prior art systems, however, when they are provided for gantry cranes having booms which are vertically retractable wherein the outer or cantilevered portion of the boom is pivoted about its inboard end and raised to clear a ship's superstructure. When the boom is raised, all of the wire rope reeving, that which moves the trolley, the hoist rope reeving for the lifting spreader, and the catenary support wire ropes, must be accommodated because they change length. This causes particular problems for the catenary trolley wire rope reeving systems of the prior art which the present invention overcomes.

In the prior art of FIG. 3, before the rotatable boom is raised, a solenoid directional control valve shifts orientation to allow the fluid inside the tensioning cylinders 79 to return to the hydraulic fluid reservoir. As a result, the tensioning cylinders extend and permit the wire ropes to go slack. Once the boom is raised to the stowed position, the directional control solenoid is shifted to the original orientation and the cylinders are hydraulically retracted and return tension to the ropes. The present invention provides a new catenary trolley wire rope drive system which eliminates the hydraulic tensioning cylinders and automatically compensates for wire rope length changes when the boom of the gantry crane is raised or lowered while keeping constant tension on the ropes.

SUMMARY OF THE INVENTION

The present invention is an improved catenary wire rope tensioning and reeving system for a cargo container handling crane having a main cargo transport trolley mounted for reciprocation along the horizontal gantry thereof, and a pair of wire rope support trolleys are mounted on opposite sides of the main trolley on the gantry for reciprocation therealong in synchronization with the main trolley to support the lift and drive ropes of the main trolley as it moves along the gantry. The system of the invention is comprised of a first pair of passive sub-drive wire ropes secured at the first ends thereof to the main trolley. The ropes are reeved around reversing sheaves mounted on the first of the pairs of support trolleys and are dead-ended at the second ends thereof to the superstructure of the crane past mid-length of the gantry and closer to the far end of the gantry from the first support trolley. A pair of continuous passive wire stabilizer ropes is secured at the first ends thereof to the first of the support trolleys and at the second ends thereof to the other or second of the support trolleys. The pair of stabilizer ropes is reeved around reversing sheaves at opposite ends of the gantry of the crane. A second pair of passive sub-drive wire ropes is secured at the first ends thereof to the main trolley. The ropes are reeved around reversing sheaves mounted on the second of the pairs of support trolleys and reeved around a sheave system fixed to the superstructure of the crane at an effective position past mid-length of the gantry and closer to the far end of the gantry from the second support trolley. A means is provided for tensioning the second pair of passive sub-drive stabilizer ropes.

OBJECTS OF THE INVENTION

It is therefore an important object of the present invention to provide an improved wire rope tensioning apparatus for a catenary wire rope support system.

It is another object of the present invention to provide a simplified wire rope tensioning apparatus for a catenary wire rope support system which is less costly to manufacture, easy to install by retrofit in the field, and easy to maintain by unskilled mechanics.

It is a further object of the present invention to provide an improved wire rope tensioning apparatus for a catenary wire rope support system which is environmentally safe and improves the ecological environment of the crane by eliminating the requirement for hydraulic power in the wire rope tensioning thereby obviating the possibility of oil spills in the ocean which create pollution problems.

And it is yet another object of the present invention to provide an improved tensioning catenary wire rope support system which is passive, automatic, and continuously operative even when the boom of the gantry crane is being raised or lowered.

Other objects and advantages of the present invention will become apparent when the apparatus of the present invention is considered in conjunction with the accompanying drawings.

DESCRIPTION OF THE PREFERRED EMBODIMENT

Figure 1:
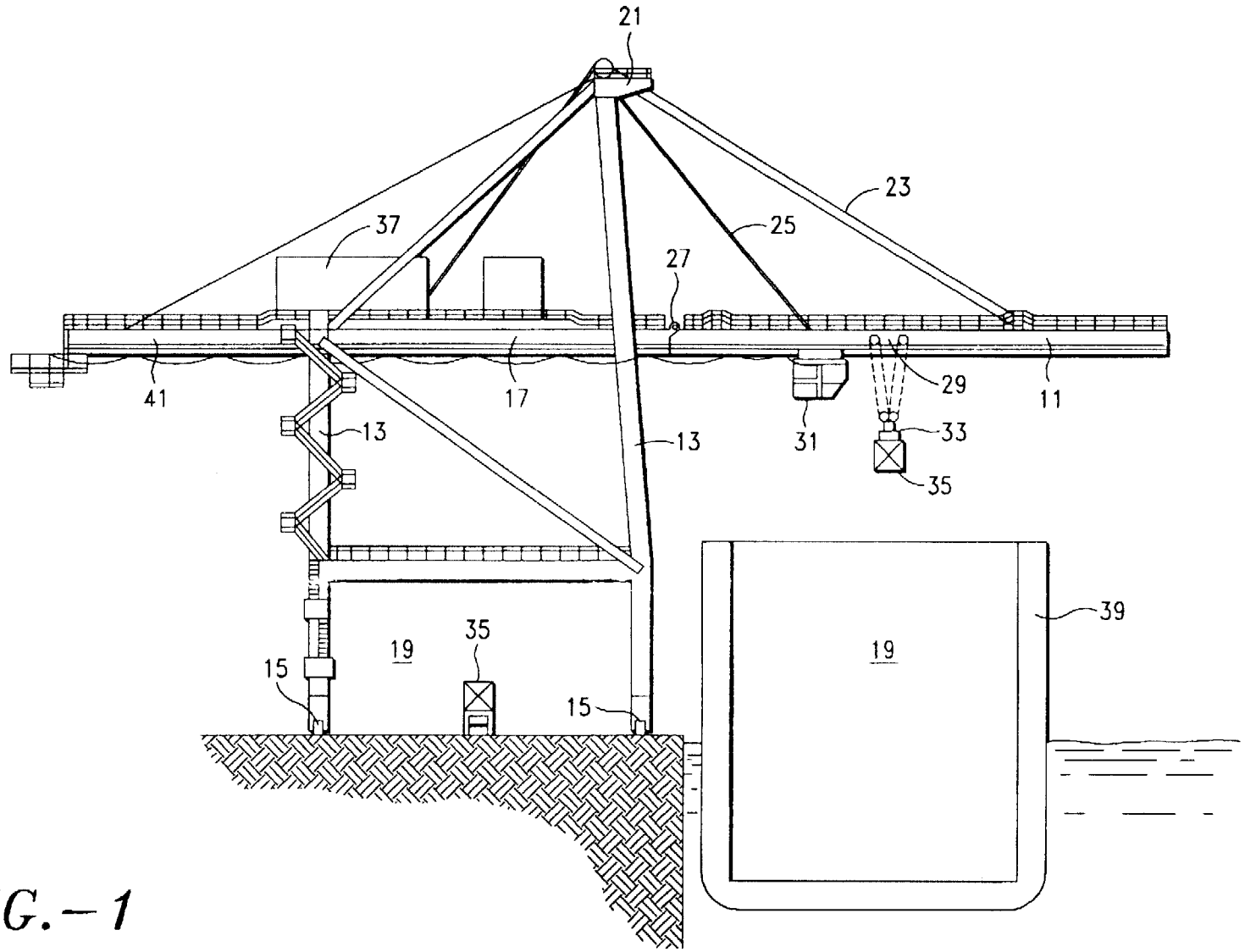
FIG. 1 is a side elevation of a typical shoreside gantry crane having a cantilevered raisable boom which can utilize the apparatus of the present invention.
Figure 2:
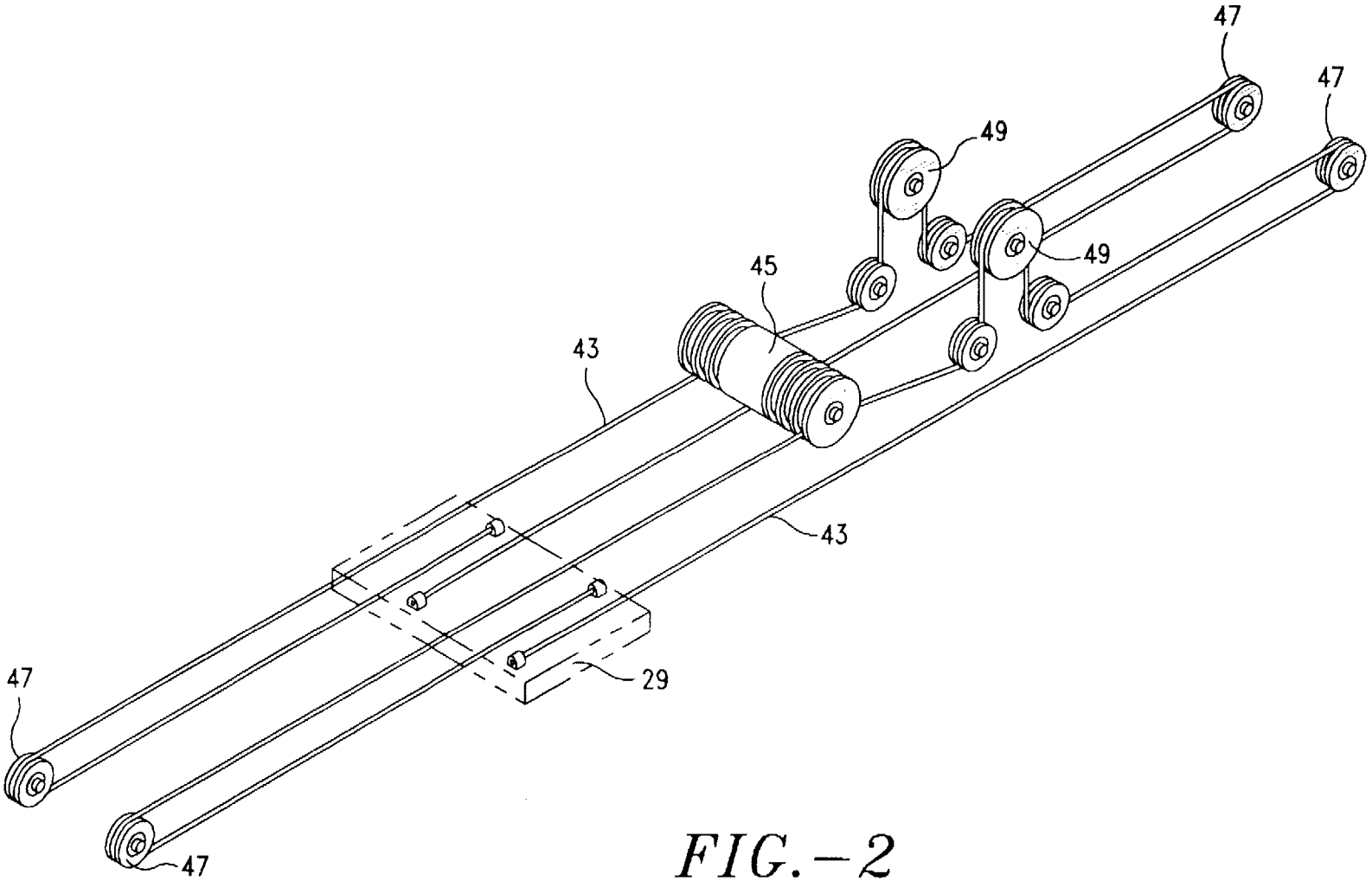
FIG. 2 is a perspective view of a basic wire rope reeving diagram for the drive ropes for the main cargo container transport trolley mounted on the gantry of the crane.
Figure 3:
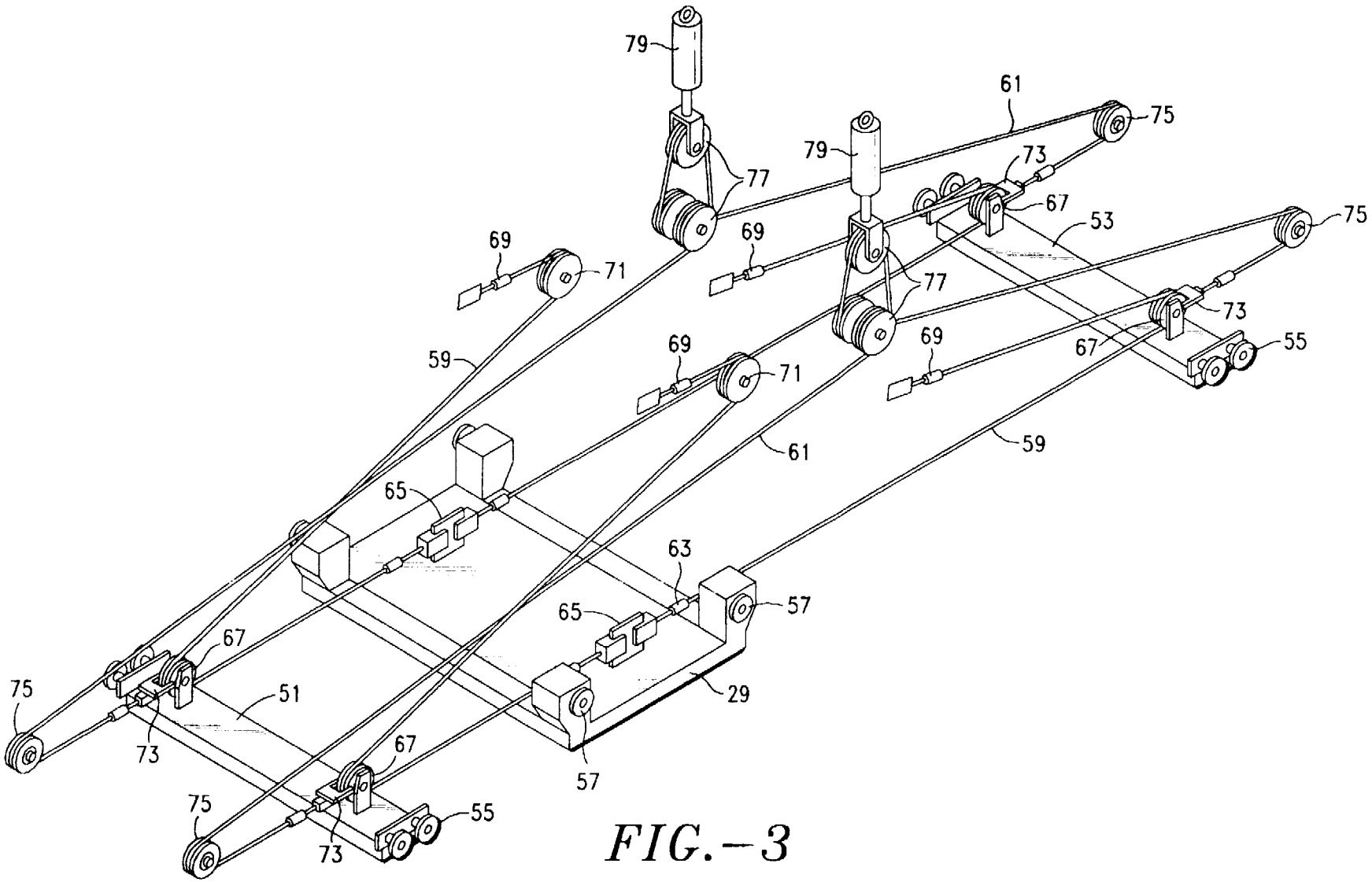
FIG. 3 is a perspective view of the basic wire rope reeving diagram for a catenary wire rope support system showing the state of the prior art.

Reference is made to the drawings for a description of the preferred embodiment of the present invention wherein like reference numbers represent like elements on corresponding views. FIGS. 1–3 have been described in the prior art section of this specification. The drive system of FIG. 2 is utilized with the present invention as well as the catenary support trolleys of FIG. 3. The wire rope reeving of the present invention, however, differs from the reeving illustrated in FIG. 3.

Figure 4:
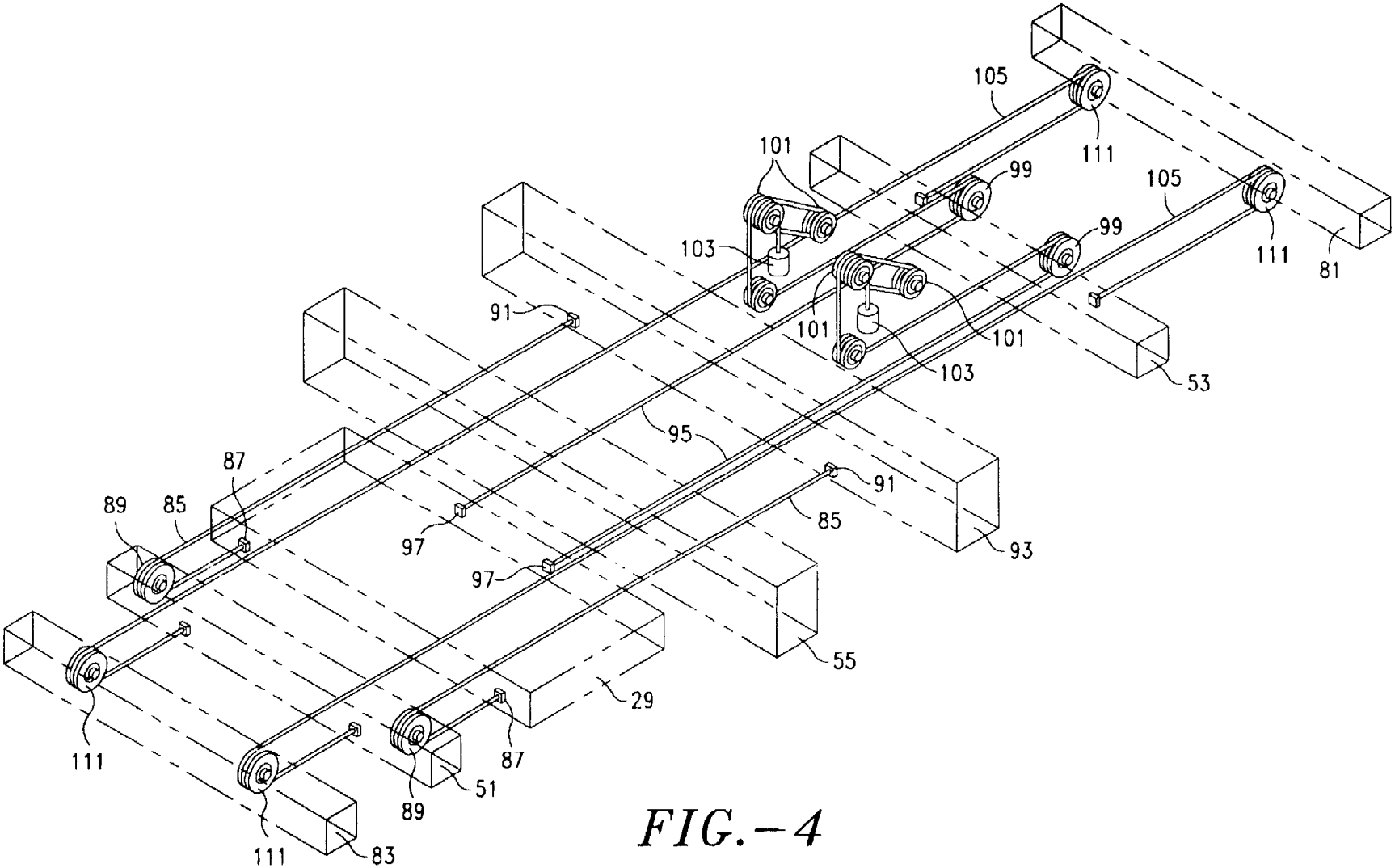
FIG. 4 is a perspective view of a wire rope reeving diagram of the present invention.
Figure 5:
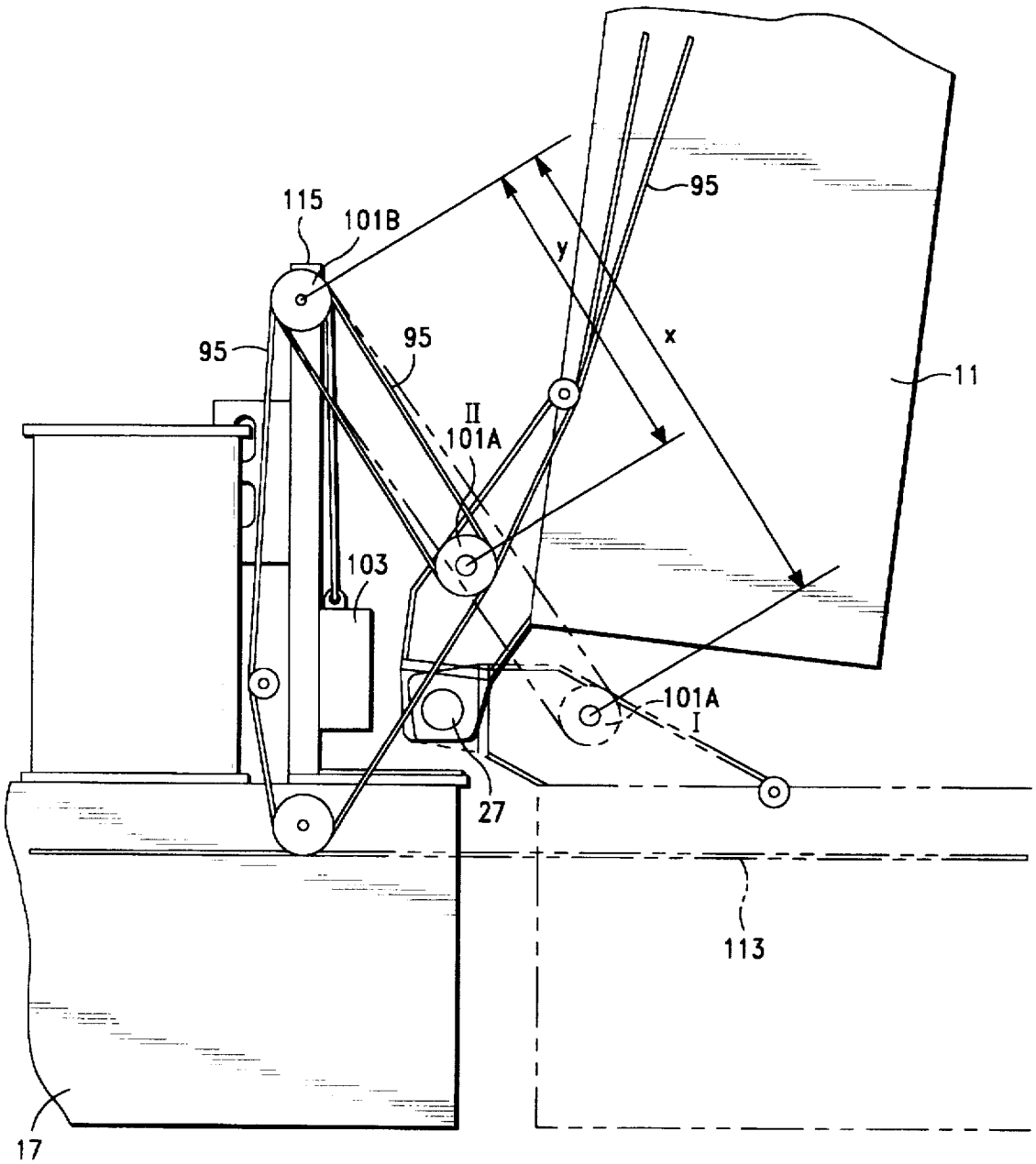
FIG. 5 is a broken out side elevation diagram of a portion of a gantry crane with the boom elevated showing the wire rope reeving of the present invention with the boom in the raised or stowed position.

FIGS. 4 and 5 illustrate the preferred embodiment of the improved catenary wire rope tensioning and reeving system of the present invention which is adoptable for use with all types of cargo container handling cranes which have an extended horizontal gantry 17 supporting a main cargo transport trolley 29. However, the invention is particularly useful for gantry cranes having a rotatable cantilever boom hinged at the inboard end thereof to the outboard end of the horizontal gantry of the crane. A main cargo container transport trolley is mounted for reciprocation along the gantry and a pair of supplementary wire rope support trolleys 51, 53 are mounted on opposite sides of the main trolley on the gantry for reciprocation along the gantry in synchronization with the main trolley as occurs in the prior art of FIG. 3.

A first supplementary landside wire rope support trolley 51 is installed between the main trolley 29 and the landside end of the crane gantry 17. Similarly, the second or waterside wire rope support trolley 53 is installed outboard on the boom 11 between the main trolley and the equalizer platform 81 located at the outboard end of the boom.

The main trolley 29 is driven from the machinery house 37 by the trolley drive drum 45 through the towing or drive ropes 43 as illustrated in FIG. 2. Similarly, as in the prior art, the cargo container lift ropes extend from the machinery house to reversing sheaves on the trolley girder end-tie 83 at the landside end of the gantry 17 and outward to the lift trolley 29 and fleet downward to the spreader 33 through sheaves mounted on the main cargo transport trolley. The wire ropes return upward from the spreader and fleet through a second set of sheaves mounted on the lift trolley and extend out to reversing sheaves mounted on the equalizer platform 81 located at the outboard opposite end of the gantry. From there they return to the machinery house in a continuous loop. Both the main trolley drive or towing ropes and the cargo container lift ropes are supported mid-span between the main trolley and the opposite ends of the gantry by fleet through support sheaves (not shown) mounted on the two supplementary catenary wire rope support trolleys 51, 53.

As in the prior art, the present invention employs a passive wire rope sub-drive system which inherently synchronizes the movement of the supplementary trolleys to keep them positioned mid-span of that portion of the gantry on which they are disposed between the main trolley and their respective ends of the gantry. The system of the present invention is described hereinafter and is a new and improved design on the systems of the prior art.

Reference is made to FIG. 4. A first pair of passive sub-drive wire ropes 85 is secured at the first ends thereof 87 to the main trolley 29. The ropes are reeved around reversing sheaves 89 mounted on the first of the pair of support trolleys 51 and are dead-ended at the second ends 91 thereof to the superstructure 93 of the crane effectively past mid-length of the gantry and closer to the far end of the gantry from the first support trolley. The sub-drive ropes must be effectively dead-ended at a position which will allow the first support trolley to move to very near to the center of the gantry, or mid-length of it, when the main trolley has moved to the far end of the gantry or boom from the first support trolley. Thus, the effective positioning of the dead-end of the rope must be at a position which permits the first support trolley to so travel. However, a direction-changing sheave so located would permit the rope to be dead-ended anywhere else on the crane. Therefore, the location of the dead-end rope securement is described in the claims hereto as meaning where it is effective, but, in fact, it does not matter where it actually is dead-ended.

A pair of continuous passive stabilizer wire ropes 105 is secured at the first ends thereof 107 to the first of the support trolleys 51 and at the second ends thereof 109 to the other or second of the support trolleys 53. The pair of stabilizer ropes are reeved around reversing sheaves 111 secured at opposite ends of the gantry of the crane to the equalizer platform 81 and the trolley girder end-tie 83. The ropes are continuous in the sense that both ends are secured to dead ends which complete a loop the same as if the ends were tied together.

An automatic continuously acting rope tensioning system is also provided by the present invention to eliminate rope slack and keep proper rope tension in the new and improved catenary rope reeving system. This is effected through a second pair of passive sub-drive wire ropes 95 which are secured at the first ends thereof 97 to the main trolley 29. The ropes are reeved around reversing sheaves 99 mounted on the second of the pair of support trolleys 53 and are reeved around pairs of take-up sheaves 101 forming a sheave system fixed to the crane superstructure. The sheave system is located on the crane at an effective position past mid-length of the gantry and closer to the far end of the gantry from the second support trolley to permit it to move to a position proximate mid-length of the gantry as with the first support trolley. A direction-changing sheave could, of course, allow the sheave system to be located anywhere on the crane.

Any means can be provided for tensioning the first and second pairs of sub-drive ropes 85, 95, and the stabilizer ropes 105 for the invention to be effective. However, in the present invention, this is accomplished by suspending a counterweight 103 at the ends of the second pair of passive sub-drive wire ropes 95. The effect of the counterweight creates the proper rope tension throughout the entire catenary wire rope reeving system.

As the main trolley 29 moves to the most outreach position, the landside catenary trolley 51 moves at half-speed of the main trolley and is pulled outboard by the main trolley to the mid-span distance between the trolley girder end-tie 83 and the main trolley. By this orientation, it provides the support for the cargo hoist or lift ropes and the trolley towing or drive ropes. As the main trolley reverses direction and travels to the landside end toward the trolley girder end-tie, the outboard or waterside support trolley 53 is towed inboard to the mid-span distance between the main trolley and the equalizer platform 81 at the outboard end of the boom 11 to provide the same rope support as the landside trolley.

Reference is made to FIG. 5 for an illustration of how the reeving system of the present invention functions when a retractable/rotatable boom is stowed. As the boom 11 raises to the stowed position, all the drive and lift wire ropes bend at the boom hinge area 27. Therefore, longer ropes are required in the rope reeving system because the ropes are deflected in a curved track around the boom hinge area instead of extending the previous straight rope line 113 as when the boom is horizontal. In a typical crane, a total of approximately 50–60 inches more rope is required to make up the rope length when the boom is raised.

The requirement for increased length in the cargo lift and trolley drive ropes is compensated for in the usual manner of the prior art. The present invention automatically compensates for the increased rope requirement in the catenary support sub-drive wire rope systems. In the preferred embodiment of the invention for utilization on a crane with a cantilevered boom which rotates about a hinge at its inboard end, the sheave system is displaced from its effective position by direction-changing sheaves to a position straddling the boom hinge. At least one of the pairs of sheaves of the sheave system is comprised of fixed sheaves mounted on the crane gantry inboard of the hinge. Another pair of fixed sheaves is mounted on the boom outboard of the hinge. As the boom is raised or lowered, the distance between the fixed sheaves with respect to each other changes and they move together or apart respectively. While the pairs of sheaves are both fixed in position on the crane superstructure, the pair of fixed sheaves on the boom moves relative to the pair of sheaves on the gantry. Thus, in this respect, the pair of sheaves on the boom is movable and is so labelled in the claims for purposes of describing how they function in the system of the present invention rather than describing their physical condition.

The sets of reeving sheaves for the rope tensioning system mounted on opposite sides of the boom hinge change position with respect to each other and feed rope into or out of the reeving system to compensate for the changing rope length requirements. The sheave system functions to accommodate the resulting changes in rope length by movement of the suspended weight. By the use of the unique sheave positioning and wire rope arrangement, the counterweight eliminates the need for the hydraulic cylinders of the prior art.

This compensation system includes the sheaves 101, the support structures 115, and the counterweight 103. The movable sheave position results from one of the sets of sheaves 101A being mounted on the boom 11 in the hinge pin area 27. The sheave position rotates around mid-length of the boom hinge pin and moves from location I to location II as illustrated in FIG. 5. After the rotation of the boom, the movable sheave 101A, which is mounted on the waterside trolley girder support beam, is located closer to the fixed sheave 101B mounted on the crane superstructure 115. The mid-length distance between the two sheaves is the longer distance "X" when the boom is down in operating condition and the shorter distance "Y" when the boom is raised to the stowed position. For a double sheave reeving system, the available or surplus rope length during the boom raising is $(X-Y)\times 2=Z$ inches, but the need is only for an amount of required rope RR. The rope length difference is $(Z-RR)=XS$. The difference in rope length and rope elongation during operation or XS are taken up by the counterweight travel which moves up and down on a guide track during the boom rotation. This passive counterweight system is continuously in operation and automatically provides the constant rope tension for both the operating and the stowed positions of the boom and during transition between the two.

No hydraulic power and cylinders are required to provide for the tensioning force and the compensation of rope length, so there is less manufacturing cost. The system is a simple mechanism which a mechanic can easily comprehend; it requires much less maintenance compared to the existing hydraulic systems; and it is also easier to install this new system in the field. There is environmental safety as no hydraulic power is required in the system, so there is no chance of oil spills into the ocean to create a pollution problem.

Thus it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

We claim:

1. An improved catenary wire rope tensioning and reeving system for a cargo container handling crane having a main cargo transport trolley mounted for reciprocation along a horizontal gantry thereof and a pair of wire rope support trolleys mounted on opposite sides of said main trolley on said gantry for reciprocation along said gantry in synchronization with said main trolley to support lift and drive ropes of said main trolley as it moves along said gantry, said system comprising a first pair of passive sub-drive wire ropes secured at the first ends thereof to said main trolley, said ropes being reeved around reversing sheaves mounted on the first of said pair of support trolleys and dead-ended at the second ends thereof to the superstructure of said crane past mid-length of said gantry and closer to the far end of said gantry from said first support trolley, a pair of passive stabilizer wire ropes secured at the first ends thereof to the first of said support trolleys and at the second ends thereof to the other or second of said support trolleys, said pair of stabilizer ropes being reeved around reversing sheaves secured to opposite ends of the gantry of said crane, a second pair of passive sub-drive wire ropes secured at the first ends thereof to said main trolley, said ropes being reeved around reversing sheaves mounted on the second of said pair of support trolleys and reeved around a sheave system fixed to the superstructure of said crane at an effective position past mid-length of said gantry and closer to the far end of said gantry from said second support trolley, and means for tensioning said second pair of passive sub-drive wire ropes.

2. The improved wire rope reeving system of claim 1 wherein the means for tensioning said second pair of passive sub-drive wire ropes includes dead-ending said ropes in said sheave system in a suspended weight.

3. The improved catenary wire rope tensioning and reeving system of claim 2 wherein the gantry of said crane includes a rotatable cantilever boom which is secured to said crane gantry by a hinge and can be rotated to a raised stowed position about its inboard end, and said pairs of sheaves of said sheave system are mounted on said gantry and boom on opposite sides of said hinge whereby as said boom is raised or lowered the distance between said pairs of sheaves changes and the change in rope length which results is accommodated by movement of said suspended weight.

4. An improved catenary wire rope tensioning and reeving system for a cargo container handling gantry crane having a rotatable cantilever boom hinged at the inboard end thereof to an outboard end of a horizontal gantry of said crane, a main cargo transport trolley mounted for reciprocation along said gantry, and a pair of wire rope support trolleys mounted on opposite sides of said main trolley on said gantry for reciprocation along said gantry in synchronization with said main trolley to support the lift and drive ropes for said main trolley as it moves along said gantry, said system comprising a first pair of passive sub-drive wire ropes secured at the first ends thereof to said main trolley, said ropes being reeved around reversing sheaves mounted on the first of said pair of support trolleys and dead-ended at the second ends thereof to the superstructure of said crane past mid-length of said gantry and closer to the far end of said gantry from said first support trolley, a pair of continuous passive stabilizer wire ropes secured at the first ends thereof to the first of said support trolleys and at the second ends thereof to the other or second of said support trolleys, said pair of stabilizer ropes being reeved around reversing sheaves secured to opposite ends of the gantry of said crane, a second pair of passive sub-drive wire ropes secured at the first ends thereof to said main trolley, said ropes being reeved around reversing sheaves mounted on the second of said pair of support trolleys, the second ends of said second sub-drive wire ropes being dead-ended in a suspended weight, a sheave system of pairs of rope take-up sheaves fixed to the superstructure of said crane disposed at an effective position past mid-length of said gantry and closer to the far end of said gantry from said second support trolley, at least one of said pairs of sheaves of said sheave system being fixed sheaves mounted on said gantry inboard of said hinge and another pair of movable sheaves mounted on said boom outboard of said hinge whereby as said boom is raised or lowered the sheaves move together or a part respectively and said sheave system functions to accommodate the resulting changes in rope length by movement of the suspended weight.

* * * * *